US010103440B2

(12) United States Patent
Helander et al.

(10) Patent No.: US 10,103,440 B2
(45) Date of Patent: Oct. 16, 2018

(54) STRIPLINE COUPLED ANTENNA WITH PERIODIC SLOTS FOR WIRELESS ELECTRONIC DEVICES

(71) Applicant: Sony Corporation, Tokyo (JP)

(72) Inventors: Jakob Helander, Lund (SE); Zhinong Ying, Lund (SE)

(73) Assignee: Sony Mobile Communications Inc., Tokyo (JP)

( * ) Notice: Subject to any disclaimer, the term of this patent is extended or adjusted under 35 U.S.C. 154(b) by 545 days.

(21) Appl. No.: 14/534,445

(22) Filed: Nov. 6, 2014

(65) Prior Publication Data

US 2016/0134021 A1 May 12, 2016

(51) Int. Cl.

| | |
|---|---|
| ***H01Q 21/08*** | (2006.01) |
| ***H01Q 9/04*** | (2006.01) |
| ***H01Q 1/24*** | (2006.01) |
| ***H01Q 1/48*** | (2006.01) |
| ***H01Q 1/52*** | (2006.01) |

(Continued)

(52) U.S. Cl.

CPC ..... *H01Q 9/0407* (2013.01); *H01Q 1/243* (2013.01); *H01Q 1/48* (2013.01); *H01Q 1/528* (2013.01); *H01Q 13/106* (2013.01); *H01Q 19/00* (2013.01); *H01Q 21/06* (2013.01); *H01Q 21/08* (2013.01)

(58) Field of Classification Search

CPC ..... H01Q 9/0407; H01Q 1/243; H01Q 1/48; H01Q 1/528; H01Q 13/106; H01Q 19/00; H01Q 21/06; H01Q 21/08

See application file for complete search history.

(56) References Cited

U.S. PATENT DOCUMENTS 5,068,670 A 11/1991 Maoz
5,175,560 A * 12/1992 Lucas ..... H01Q 13/085 343/767

(Continued)

FOREIGN PATENT DOCUMENTS

EP 0541276 5/1993
EP 2 408 062 A1 1/2012

(Continued)

OTHER PUBLICATIONS

Yang, Fan and Yahya Rahmat-Samii. *Electromagnetic Band Gap Structures in Antenna Engineering.* 1st ed. Cambridge: Cambridge University Press, 2008. *Cambridge Books Online.* Web. Nov. 5, 2014. http://dx.doi.org/10.1017/CBO9780511754531.

(Continued)

*Primary Examiner* — Graham Smith
*Assistant Examiner* — Noel Maldonado
(74) *Attorney, Agent, or Firm* — Myers Bigel, P.A.

(57) ABSTRACT

A wireless electronic device includes a ground plane including a plurality of slots located along an edge of the ground plane. A dielectric layer is on the ground plane. A stripline on the dielectric layer is opposite the ground plane, positioned to overlap one of the plurality of slots. The stripline is further positioned to not overlap slots adjacent the one of the plurality of slots that the stripline overlaps. The wireless electronic device is configured to resonate at a resonant frequency when excited by a signal transmitted and/or received though the stripline.

22 Claims, 11 Drawing Sheets

(51) Int. Cl.

| | |
|---|---|
| ***H01Q 13/10*** | (2006.01) |
| ***H01Q 19/00*** | (2006.01) |
| ***H01Q 21/06*** | (2006.01) |

(56) References Cited

U.S. PATENT DOCUMENTS

| | | | | |
|---|---|---|---|---|
| 5,596,337 | A * | 1/1997 | Merenda | H01Q 21/0075 343/770 |
| 2004/0239575 | A1 | 12/2004 | Shoji et al. | |
| 2007/0171140 | A1* | 7/2007 | Minard | H01Q 1/2275 343/770 |
| 2008/0284670 | A1 | 11/2008 | Kanno et al. | |
| 2010/0134377 | A1 | 6/2010 | Tsai et al. | |
| 2010/0225553 | A1* | 9/2010 | Minard | H01Q 21/28 343/770 |
| 2014/0240177 | A1 | 8/2014 | Wang et al. | |

FOREIGN PATENT DOCUMENTS

| | | | |
|---|---|---|---|
| JP | 5315833 | A | 11/1993 |
| JP | 2010213270 | A | 9/2010 |
| KR | 10-2006-0035588 | | 4/2006 |
| WO | WO 01/52352 | A1 | 7/2001 |

OTHER PUBLICATIONS

Korean Intellectual Property Office Notice of Preliminary Rejection corresponding to Korean Patent Application No. 10-2017-7013048, 10 pages (dated Feb. 13, 2018) (with English Translation).

International Search Report and Written Opinion of the International Searching Authority, Application No. PCT/JP2015/002312, dated Jul. 20, 2015.

Cheng et al., "Body Surface Backed Flexible Antennas for 17 GHz Wireless Body Area Networks Sensor Applications", *Proceedings of the 10th European Conference on Wireless Technology,* Munich, Germany, Oct. 2007, pp. 55-58.

* cited by examiner

| | |
|---|---|
| Type | Farfield |
| Approximation | enabled (kR >> 1) |
| Monitor | farfield (f=15) [AC1] |
| Component | Abs |
| Output | Gain |
| Frequency | 15 |
| Rad. effic. | -0.2113 dB |
| Tot. effic. | -0.8218 dB |
| System [AC1]: | |
| Rad. effic. | -0.2113 dB |
| Tot. effic. | -0.8116 dB |
| Gain | 9.087 dB |

STRIPLINE COUPLED ANTENNA WITH PERIODIC SLOTS FOR WIRELESS ELECTRONIC DEVICES

TECHNICAL FIELD

The present inventive concepts generally relate to the field wireless communications and, more specifically, to antennas for wireless communication devices.

BACKGROUND

Communication devices such as cell phones and other user equipment may include antennas that can be used to communicate with external devices. These antennas designs may include a stripline. Some antenna designs with striplines, however, may facilitate undesirable surface waves that affect the performance of the antenna.

SUMMARY

Various embodiments of the present inventive concepts include a wireless electronic device including a ground plane with a plurality of slots located along an edge of the ground plane, a dielectric layer on the ground plane, and a stripline on the dielectric layer opposite the ground plane. The stripline may be positioned to overlap one of the plurality of slots. The stripline may be further positioned to not overlap slots adjacent the one of the plurality of slots that the stripline overlaps. The wireless electronic device may be configured to resonate at a resonant frequency when excited by a signal transmitted and/or received though the stripline.

According to various embodiments, the stripline may include a plurality of bends in the stripline that define a plurality of portions of the stripline. Respective lengths of each of the plurality of portions may be selected to configure the wavelength of the stripline as approximately 0.25 times an effective wavelength of the resonant frequency of the wireless electronic device.

In various embodiments, the slots adjacent the one of the plurality of slots overlapped by the stripline may include a first slot on a first side of the one of the plurality of slots and a second slot on a second side, opposite the first side, of the one of the plurality of slots. The plurality of bends in the stripline may consist of two bends in the stripline. The bends in the stripline may form approximately 90 degree angles between adjacent portions of the stripline. The plurality of bends in the stripline may define a U-shaped end of the stripline. The U-shaped end of the stripline may have a base and a pair of arms, and the base may be configured to pass over the slot. The base may be configured to pass over the one of the plurality of slots parallel to the edge of the ground plane. The base may be configured to pass over and cross the one of the plurality of slots. The stripline may be positioned to impedance match the dielectric layer and/or ground plane.

In some embodiments, a length of one of the plurality of slots may be approximately 0.25 times a wavelength of the resonant frequency of the wireless electronic device. The width of the one of the plurality of slots may be approximately 0.2 times the length of the one of the plurality of slots. Slots that are not overlapped by the stripline may reduce the propagation of surface waves near the stripline.

According to various embodiments, the stripline may be a first stripline. The wireless electronic device may further include one or more additional striplines, where each of the one or more additional striplines may overlap respective ones of the plurality of slots. The one or more additional striplines may be further positioned to not overlap slots adjacent the respective ones of the plurality of slots overlapped by the one or more additional striplines.

In some embodiments, the one of the plurality of slots may be a first slot. The slots adjacent the first slot overlapped by the stripline may include a second slot adjacent a first side of the first slot and a third slot adjacent a second side, opposite the first side, of the first slot. The one or more additional striplines may include a second stripline that overlaps a fourth slot, that is adjacent a fifth slot and a sixth slot that are not overlapped by the first stripline or the one or more additional striplines. The fifth slot may be adjacent a first side of the fourth slot, and the sixth slot is adjacent a second side, opposite the first side of the fourth slot. The fifth slot may be adjacent the third slot.

According to various embodiments, the distance between adjacent ones of the plurality of slots may be between 0.1 and 0.2 times a wavelength of the resonant frequency of the wireless electronic device. The distance between adjacent ones of the additional striplines may be between 0.25 and 0.5 times a wavelength of the resonant frequency of the wireless electronic device. The first stripline and the one or more additional striplines may be arranged in an array. The striplines may be configured to receive and/or transmit multiple-input and multiple-output (MIMO) communication. Respective radiation fields formed by the dielectric layer and the first stripline and/or the one or more additional striplines additively couple to form an electromagnetic radiation beam.

In various embodiments, at least one of the plurality of slots may be approximately perpendicular to the edge of the ground plane. At least one of the plurality of slots may be diagonally oriented to the edge of the ground plane. The stripline may include one or more bends and is positioned to overlap one of the plurality of slots.

In some embodiments, the plurality of slots may be along one edge of the ground plane. The one edge of the ground plane may along an edge of a mobile device.

Various embodiments of the present inventive concepts include a wireless electronic device including a ground plane with a plurality of slots located along an edge of the ground plane, a dielectric layer on the ground plane, and a plurality of striplines on the dielectric layer opposite the ground plane. Each of the plurality of striplines may be positioned to overlap a respective one of the plurality of slots. Each stripline of the plurality of striplines may be further positioned to not overlap slots adjacent the respective one of the plurality of slots that the stripline overlaps. The wireless electronic device may be configured to resonate at a resonant frequency when excited by a signal transmitted and/or received though at least one of the plurality of striplines.

Other devices and/or operations according to embodiments of the inventive concept will be or become apparent to one with skill in the art upon review of the following drawings and detailed description. It is intended that all such additional devices and/or operations be included within this description, be within the scope of the present inventive concept, and be protected by the accompanying claims. Moreover, it is intended that all embodiments disclosed herein can be implemented separately or combined in any way and/or combination.

DETAILED DESCRIPTION

Figure 1:
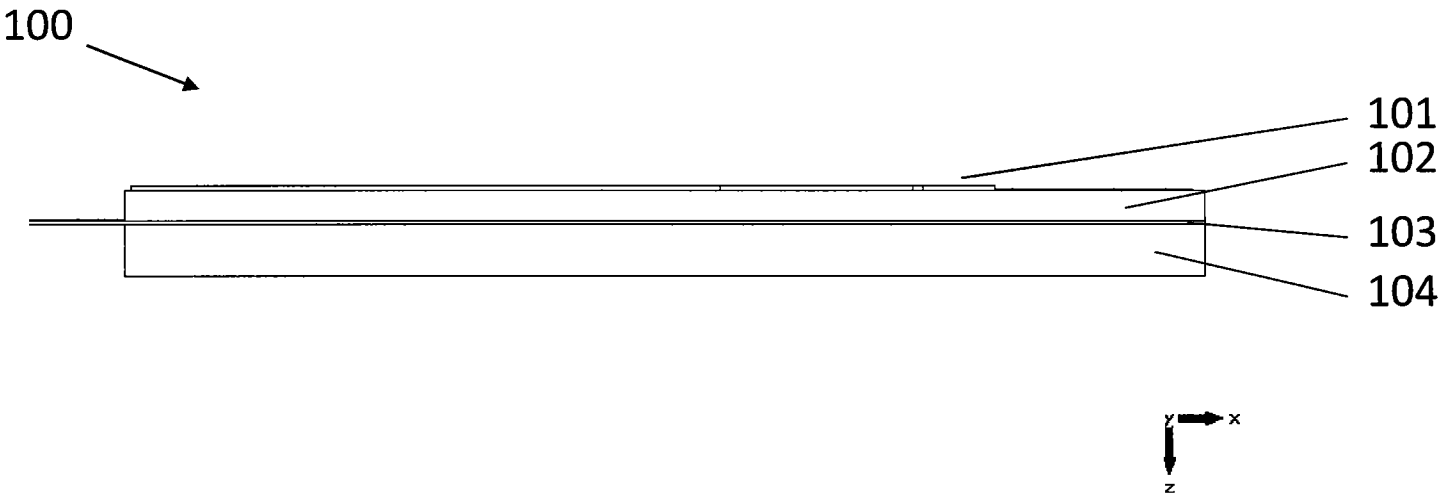
FIG. 1 illustrates an stripline antenna of a wireless electronic device, according to various embodiments of the present inventive concepts.

The present inventive concepts now will be described more fully with reference to the accompanying drawings, in which embodiments of the inventive concepts are shown. However, the present application should not be construed as limited to the embodiments set forth herein. Rather, these embodiments are provided so that this disclosure will be thorough and complete, and to fully convey the scope of the embodiments to those skilled in the art. Like reference numbers refer to like elements throughout.

The terminology used herein is for the purpose of describing particular embodiments only and is not intended to be limiting of the embodiments. As used herein, the singular forms "a," "an," and "the" are intended to include the plural forms as well, unless the context clearly indicates otherwise. It will be further understood that the terms "comprises," "comprising," "includes," and/or "including," when used herein, specify the presence of stated features, steps, operations, elements, and/or components, but do not preclude the presence or addition of one or more other features, steps, operations, elements, components, and/or groups thereof. In contrast, the term "consisting of" (and variants thereof) when used herein, specifies the stated features, integers, steps, operations, elements, and/or components, and precludes additional features, integers, steps, operations, elements and/or components.

It will be understood that when an element is referred to as being "coupled," "connected," or "responsive" to another element, it can be directly coupled, connected, or responsive to the other element, or intervening elements may also be present. In contrast, when an element is referred to as being "directly coupled," "directly connected," or "directly responsive" to another element, there are no intervening elements present. As used herein, the term "and/or" includes any and all combinations of one or more of the associated listed items.

Spatially relative terms, such as "above," "below," "upper," "lower," "top," "bottom," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms "first," "second," etc. may be used herein to describe various elements, these elements should not be limited by these terms. These terms are only used to distinguish one element from another. Thus, a first element could be termed a second element without departing from the teachings of the present embodiments.

Unless otherwise defined, all terms (including technical and scientific terms) used herein have the same meaning as commonly understood by one of ordinary skill in the art to which these embodiments belong. It will be further understood that terms, such as those defined in commonly-used dictionaries, should be interpreted as having a meaning that is consistent with their meaning in the context of the relevant art and will not be interpreted in an idealized or overly-formal sense unless expressly so defined herein.

Antennas with striplines are commonly used in microwave antenna designs for mobile terminals. These antenna designs may be compact in size and easy to manufacture since they may be implemented as edge printed features on printed circuit boards (PCBs). Various wireless communication applications may use an array of these stripline antennas. Array antennas may offer potential antenna gains with correct phasing. A disadvantage of stripline antenna designs may be the propagation of surface waves along an edge of the PCB. These surface waves may cause higher radiation coupling between antenna array elements and may induce irregular radiation patterns with higher losses at some frequencies due to coupling from neighboring striplines. Higher coupling between antenna array elements and irregular radiation patterns may not be suitable for extremely high frequency (EHF) radio antenna applications such as millimeter wave antenna arrays for use in the 10 to 300 GHz frequency range. These millimeter wave frequencies may be used for various types of communication in smart phones such as broadband internet access, Wi-Fi, etc. Moreover, array antennas may narrow the radiation pattern into a beam that is directional and may require the device to be directed towards the base station.

According to various embodiments of the present inventive concepts, the stripline antenna design may be improved by adding slots to the ground plane. The slots may stop, prevent, and/or reduce surface waves, reduce side lobes in the radiation pattern, and/or reduce mutual coupling between array elements. The stripline antenna with a slotted ground plane may exhibit good polarization characteristics with a broad radiation beam that is substantially symmetric with wide scanning angles.

Referring now to FIG. 1, an antenna including a stripline 101 of a wireless electronic device 100 is illustrated. A ground plane 103 has a dielectric layer 102 above and a dielectric layer 104 below the ground plane 103. The ground plane 103 may include a conductive material such as copper. A stripline 101 is on the dielectric layer 102 opposite the ground plane. The dielectric layers 102 and 104 may include a material with a high dielectric constant and a low dissipation factor tan δ. For example, a material such as Rogers RO4003C may be used as the dielectric layers 102 and 104, such that the dielectric constant $\in_r$=3.55 and the dissipation factor tan δ=0.0027 at 10 GHz.

Figure 2:
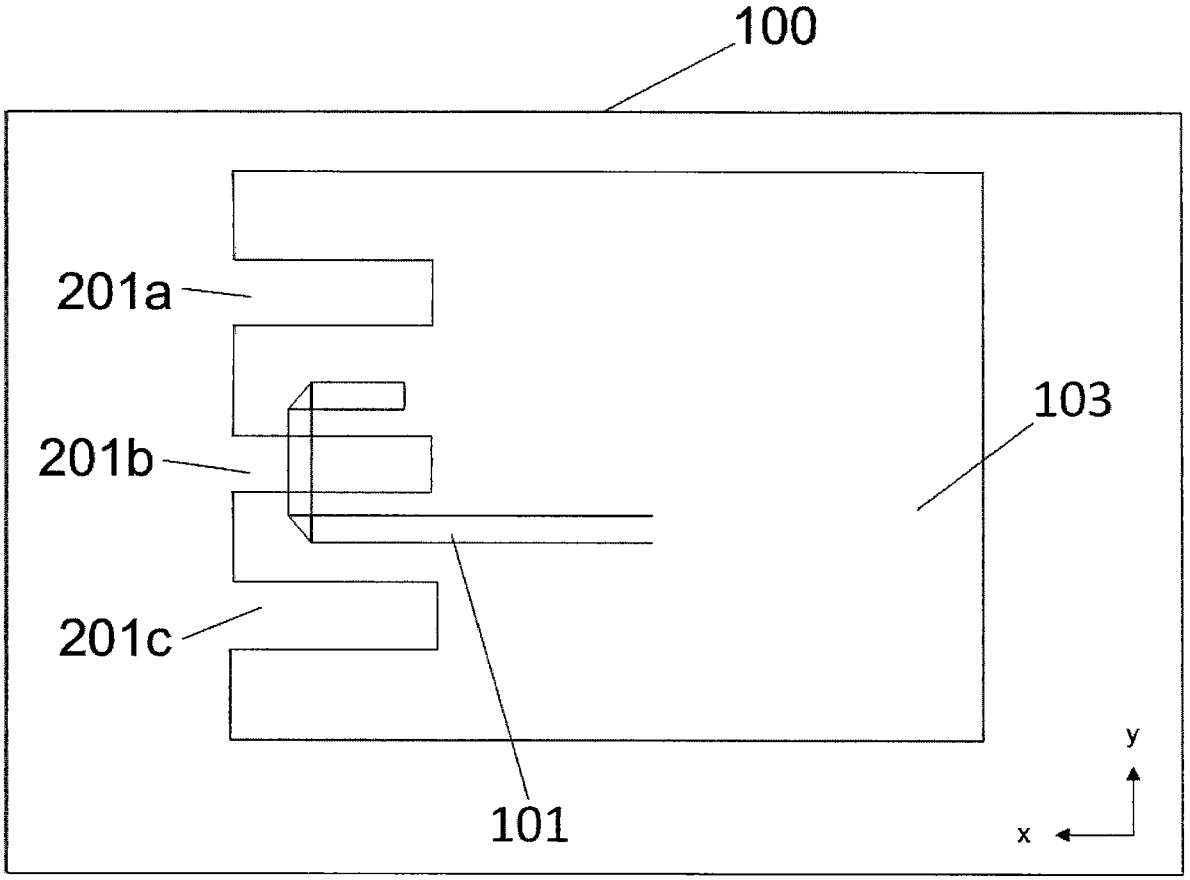
FIG. 2 illustrates a plan view of the stripline antenna of FIG. 1 including slots in the ground plane, according to various embodiments of the present inventive concepts.

Referring now to FIG. 2, slots 201*a*-201*c* in the ground plane 103 of the wireless electronic device 100 of FIG. 1 are illustrated. A stripline 101 overlaps the middle slot 201*b* and may include an active element spaced apart from the ground plane. A signal received at the stripline 101 may excite the wireless electronic device 100. The stripline 101 may be coupled to a transceiver for sending and receiving communication signals. Slots 201*a*-201*c* are on a same layer of the PCB as the ground plane 103. The stripline 101 may be located on a different layer of the PCB from the ground plane 103.

Still referring to FIG. 2, slots 201*a* and 201*c*, which are adjacent slot 201*b*, are not overlapped by the stripline 101. At least one of the slots 201*a*-201*c* may be perpendicular to the edge of the ground plane 103. In some embodiments, slots 201*a*-201*c* may be corrugated such that the slots are shaped into alternate ridges and grooves. If slots 201*a*-201*c* are not present along the edge of the ground plane 103, surface waves may readily propagate along the edge of a PCB that includes the ground plane 103. Slots 201*a* and 201*c* reduce and/or prevent surface waves from propagating along the end of the PCB. In other words, the slots 201*a* and 201*c* that surround but do not overlap the stripline may choke the surface waves. Additionally, edge currents may be reduced and/or prevented by the presence of slots 201*a*-203*a*. In some embodiments, it may be desired to not completely eradicate the surface waves (i.e. not complete choke the surface waves) in order to obtain a wider scanning angle for the wireless electronic device 100.

Still referring to FIG. 2, slots 201*a*-201*c* may each have a length in the range of 0.2 to 0.4 wavelengths of the resonant frequency of the wireless electronic device 100. In some embodiments the length of slots 201*a*-201*c* may be 0.25 wavelengths of the resonant frequency of the wireless electronic device. The width of each of the slots 201*a*-201*c* may be 0.2 times the length of the respective slot.

Figure 3:
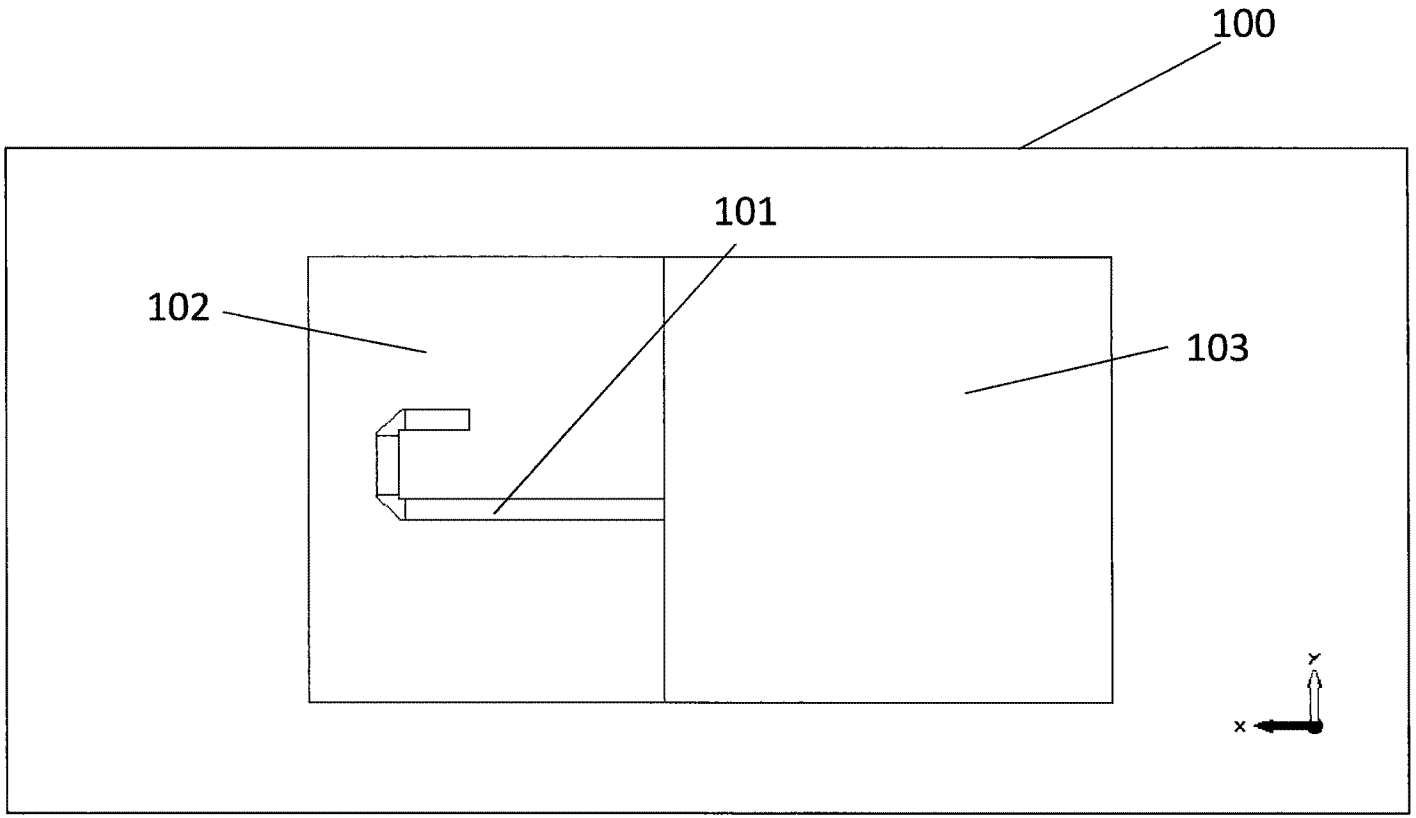
FIG. 3 illustrates a plan view of the stripline antenna of FIG. 1, according to various embodiments of the present inventive concepts.

Referring now to FIG. 3, a plan view of the wireless electronic device 100 of FIG. 1 if illustrated. A dielectric layer 102 is on the ground plane 103. A stripline 101 is on the dielectric layer. The stripline 101 is located on a different layer of the PCB from the ground plane 103. The dielectric layer 102 is located on a different layer from the ground plane 103 and the stripline 101.

In some embodiments, the dielectric layer 102 may include slots. Slots in the dielectric layer 102 may be of the same width and/or length as the slots in the ground plane 103. In some embodiments, slots in the dielectric layer 102 may be greater or smaller in dimension than slots in the ground plane 103. The slots in the dielectric layer 102 may coincide with the location of the slots in the ground plane 103 or may not overlap the slots in the ground plane 103.

Figure 4:
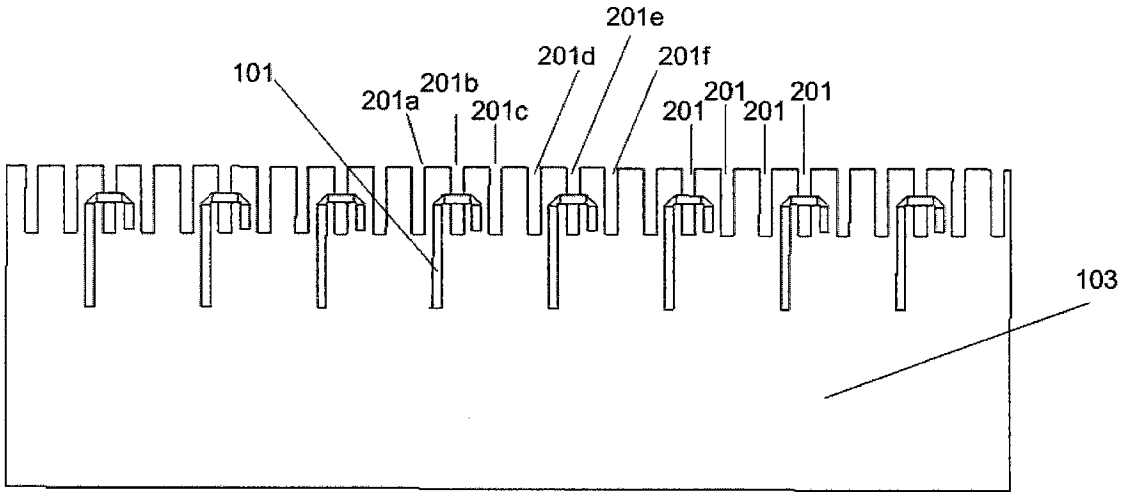
FIG. 4 illustrates a slotted ground plane with multiple striplines, according to various embodiments of the present inventive concepts.

Referring now to FIG. 4, a ground plane 103 with multiple slots 201 and multiple striplines 101 are illustrated. For example, an 8×1 array with eight striplines 101 and twenty-four slots 201, including slots 201*a*-201*f*, are illustrated. However, fewer or greater numbers may be provided according to various embodiments of the inventive concepts. The array may be configured as two 4×1 arrays to receive and/or transmit multiple-input and multiple output (MIMO) communications for 4G and/or LTE networks. Spacing between striplines 101 may be in the range between 0.25 and 0.5 wavelengths of the resonant frequency of the wireless electronic device. Spacing between adjacent slots 201 may be between 0.1 and 0.2 wavelengths of the resonant frequency of the wireless electronic device. In some embodiments, the striplines 101 may be spaced 0.45 wavelengths apart and the slots 201 may be spaced 0.15 wavelengths apart. The aforementioned spacing between slots 201 and striplines 101 may be based on the free space wavelength or the effective wavelength used for tuning. Typically, the effective wavelength may be slighter smaller than the free space wavelength due to loading by the dielectric layer.

Still referring to FIG. 4, as a non-limiting example, a stripline 101 overlaps slot 201*b*. Slots adjacent to slot 201*b*, 201*a* and 201*c*, are not overlapped by striplines 101. Slot 201*e* is overlapped by a different stripline 101, while adjacent slots 201*d* and 201*f* are free of overlap by striplines 101. In some embodiments, slots 201*a*, 201*c*, 201*d*, and/or 201*f* may behave as parasitic elements.

Figure 5:
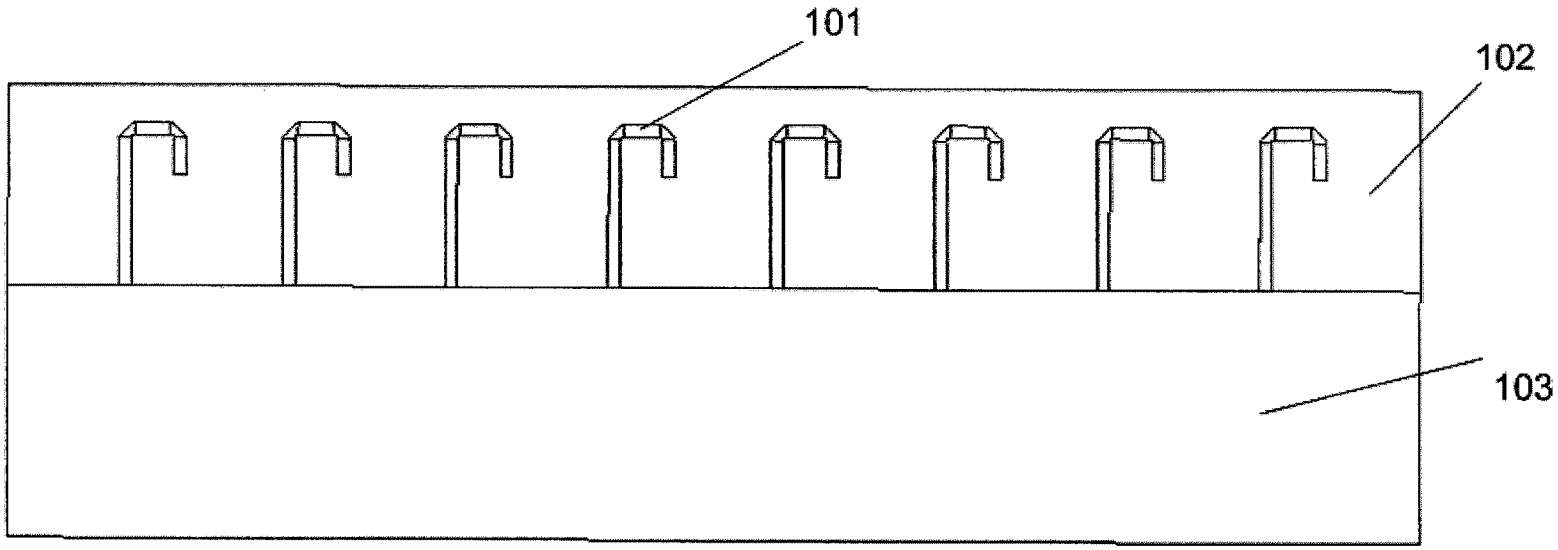
FIG. 5 illustrates an antenna with multiple striplines including the slotted ground plane of FIG. 4, according to various embodiments of the present inventive concepts.

Referring now to FIG. 5, multiple striplines 101 including a ground plane 103 of FIG. 4 and a dielectric layer 102 are illustrated. The striplines 101, dielectric layer 102, and ground plane 103 may be on different layers of the PCB. The striplines 101 may be positioned over a slot to achieve desirable coupling and for impedance matching to the dielectric layer 102 and/or ground plane 103. Impedance matching reduces mismatch losses by minimizing the power reflected from the load (i.e. the antenna), and maximizing the power delivered to the antenna.

Figure 6:
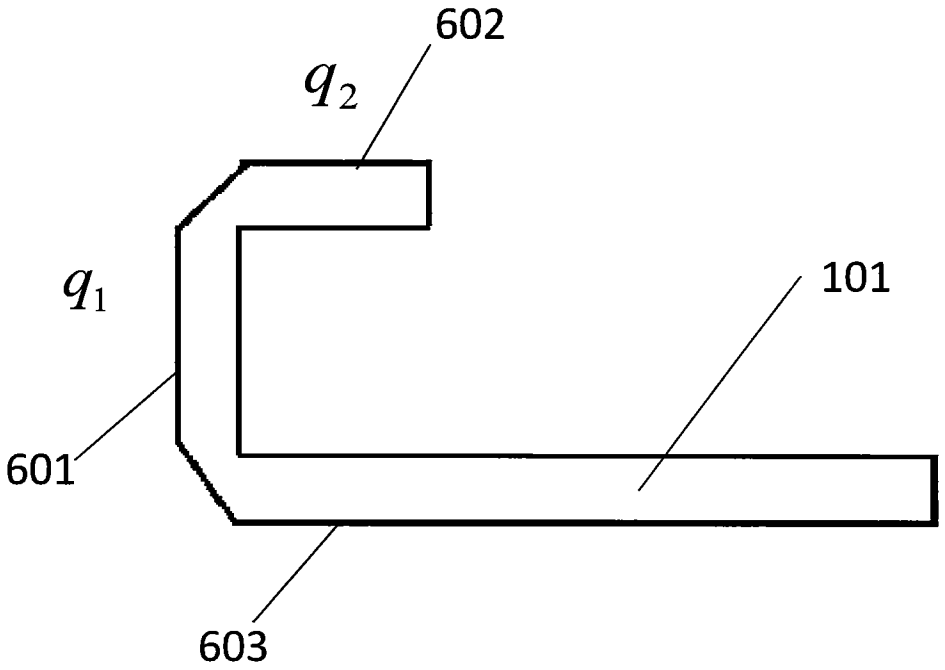
FIG. 6 illustrates a stripline used in any of FIGS. 1-5, according to various embodiments of the present inventive concepts.

Referring now to FIG. 6, a stripline 101 used in any of FIGS. 1-5 is illustrated. The stripline 101 may include a one or more bends. Bending of the stripline may facilitate the radiation pattern to be centered around the stripline and associated slot, with less coupling to neighboring striplines. The bends in the stripline 101 may define a plurality of portions of the stripline 101. As a non-limiting example, stripline 101 of FIG. 6 may include two bends, dividing the stripline into portions $q_1$ and $q_2$. The lengths of the portions of the stripline 101 may be selected such that when the stripline 101 is excited, coupling to slots below and adjacent the stripling 101 achieves 0.25 wavelength of the resonance of the wireless electronic device. For example, $q_1+q_2 \approx \lambda_{eff}/4$. The bends in the stripline 101 may form approximately 90 angles between adjacent portions of the stripline 101. In some embodiments, the plurality of bends in the stripline 101 may define a U-shaped end of the stripline 101. The U-shaped end of the stripline 101 may include a base 601 and a pair of arms 602 and 603. The U-shaped end of the stripline 101 may pass over one of the slots 201 of the ground plane 103. Specifically, the base 601 may pass over one of the slots parallel to the edge of the ground plane. In some embodiments, the base may pass over and cross one of the slots in the ground plane.

Figure 7A:
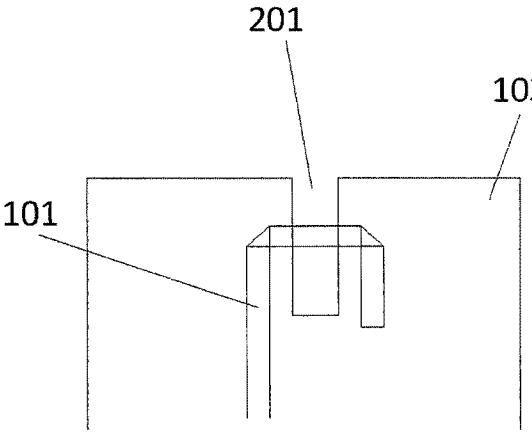
FIG. 7A illustrates a singled slotted ground plane and a stripline, according to various embodiments of the present inventive concepts.
Figure 7B:
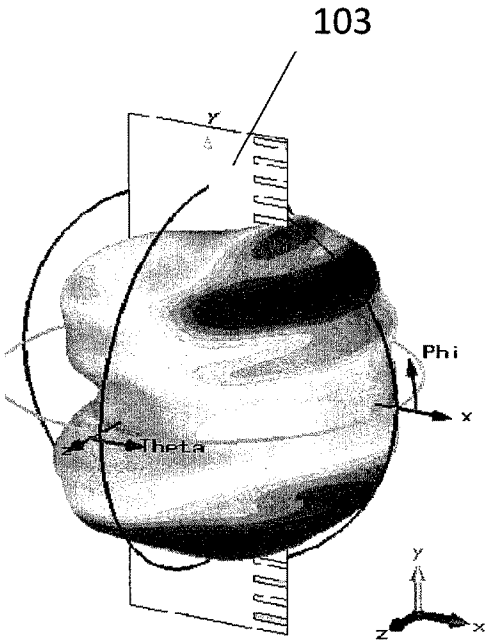
FIG. 7B illustrates the radiation pattern for an antenna with a single slot in the ground plane per stripline, according to various embodiments of the present inventive concepts.
Figure 7C:
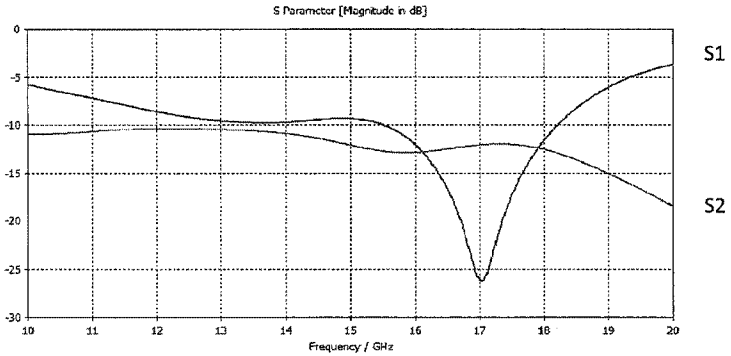
FIG. 7C illustrates the frequency response of the antenna of FIGS. 7A and 7B, according to various embodiments of the present inventive concepts.

Referring now to FIG. 7A, a ground plane 103 with a single slot 201 associated with a stripline 101 is illustrated. Adjacent slots not overlapped by a stripline are not present in this configuration. Referring now to FIG. 7B, a radiation pattern for an antenna with a single slot in the ground plane per stripline is illustrated. The radiation pattern around the ground plane 103 includes irregular side lobes and distortion that is not suitable for communication at the extremely high frequencies (EHFs). Referring now to FIG. 7C, the frequency response of the antenna of FIGS. 7A and 7B is illustrated. Si illustrates frequency distortion with significant distortion at 17 GHz due to coupling between radiation patterns from neighboring striplines. S2 illustrates the matching loss of one single stripline 101 associated with a single slot 201. Additionally, for this single slot case, there appears to not be much correlation between curves S1 and S2.

Figure 8A:
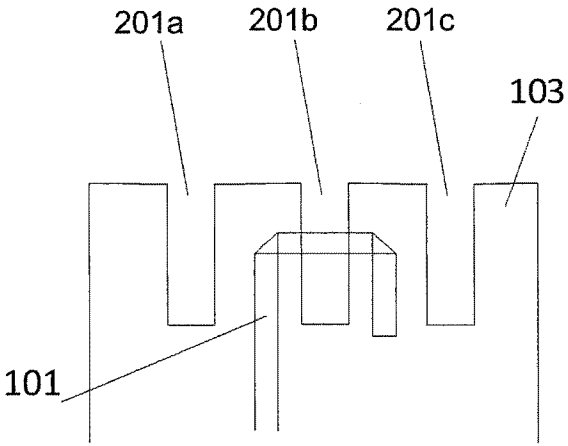
FIG. 8A illustrates an antenna including multiple slots in the ground plane and a stripline, according to various embodiments of the present inventive concepts.
Figure 8B:
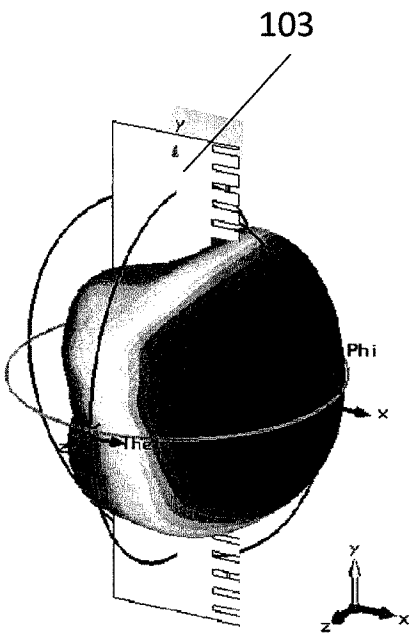
FIG. 8B illustrates the radiation pattern for an antenna with multiple slots in the ground plane per stripline, according to various embodiments of the present inventive concepts.

Referring now to FIG. 8A, an antenna including multiple slots 201 in the ground plane 103 associated with a stripline 103 are illustrated. Stripline 101 overlaps the middle slot 201*b*. Slots 201*a* and 201*c* are adjacent slot 201*b*, and may not overlapped by the stripline 101. Referring now to FIG. 8B, a radiation pattern for an antenna with a multiple slots in the ground plane per stripline, as in FIG. 8A is illustrated. The radiation pattern spans broadly and uniformly around the ground plane 103 with few prominent side lobes and little distortion compared to the radiation pattern of FIG. 7B. Accordingly, various embodiments of FIGS. 8A and 8B may offer improved performance compared to embodiments of FIGS. 7A and 7B. For example, the adjacent slots 201*a* and 201*c* of FIGS. 8A control surface waves on the antenna, allowing for a wider single element far field pattern. The wider single element far field pattern with solid angles will provide for a larger beam sweep, resulting in a larger total scanning area. If the single element far field is wide, an antenna array configuration as in FIG. 8B will produce an array gain larger than a threshold in a larger fraction of a spherical area around the antenna. In comparison, a more narrow single element pattern produced by the structure of FIG. 7A will reduce the array gain in FIG. 7B at large scanning angles since a single element as in FIG. 7A does not contribute as much gain at the larger scanning angles.

Figure 8C:
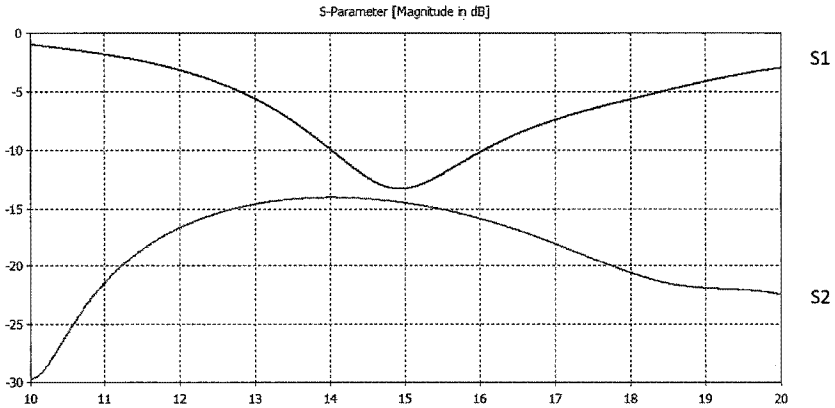
FIG. 8C illustrates the frequency response of the antenna of FIGS. 8A and 8B, according to various embodiments of the present inventive concepts.

Referring now to FIG. 8C, the frequency response of the antenna of FIGS. 8A and 8B is illustrated. S1 illustrates frequency distortion with distortion at 15 GHz that is less than the distortion illustrated in FIG. 7C. S2 illustrates the matching loss of a single stripline 101 associated with slots 201*a*-201*c*. Additionally, for this multiple slot case, there appears to be correlation between curves S1 and S2, making it easier to compensate for the distortion.

Figure 9:
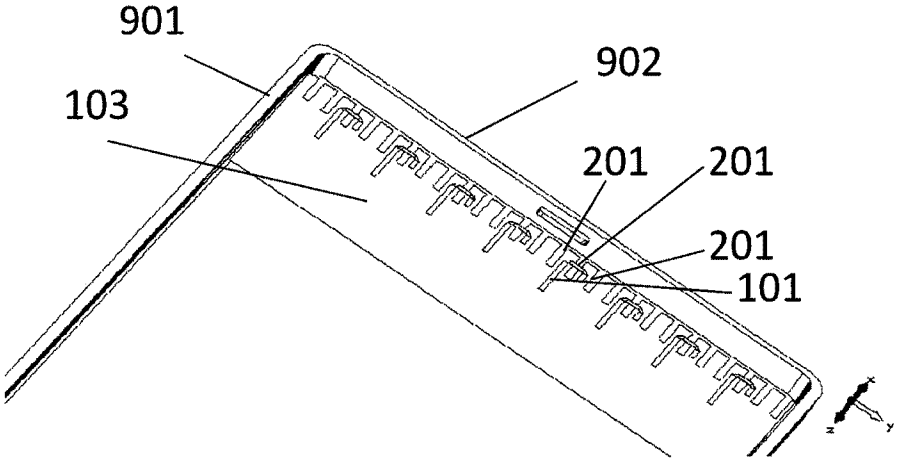
FIG. 9 illustrates an array of striplines and multiple slots per stripline in the ground plane along an edge of a mobile device, according to various embodiments of the present inventive concepts.
Figure 10:
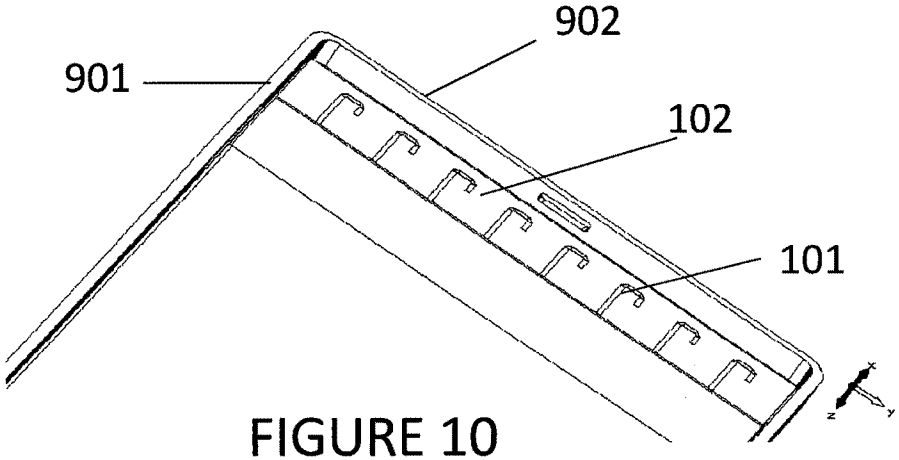
FIG. 10 illustrates an array of striplines along an edge of a mobile device on a dielectric layer, according to various embodiments of the present inventive concepts.
Figure 11:
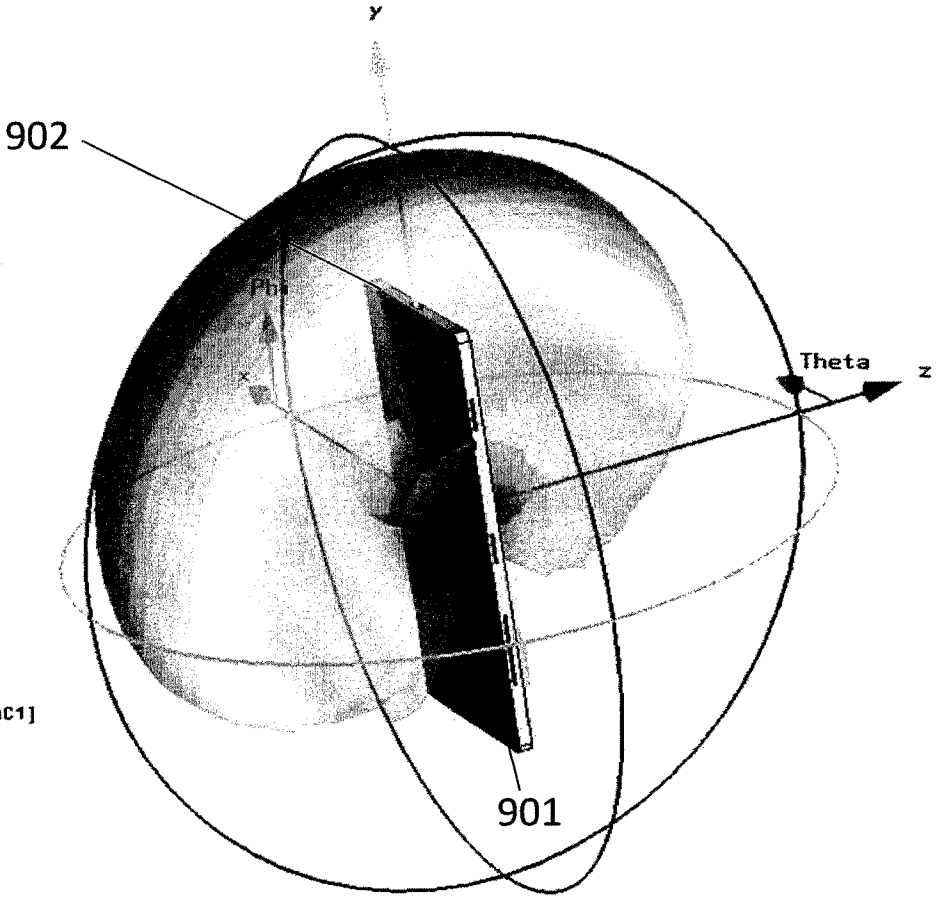
FIG. 11 illustrates the radiation pattern around a mobile device including the array antenna of FIGS. 9 and 10, according to various embodiments of the present inventive concepts.

Referring now to FIG. 9, an array of striplines 101 and multiple slots per stripline 201 in the ground plane 103 along an edge 902 of a mobile device 901 is illustrated. Referring now to FIG. 10, an array of striplines 101 along an edge 902 of a mobile device 901 on a dielectric layer 102 is illustrated. Referring now to FIG. 11, the radiation pattern around a mobile device 901 including the array antenna of FIGS. 9 and 10 is illustrated. The slots of the ground plane in the mobile device 901 of FIG. 11 may be located at the top edge 902 of the mobile device 901. The radiation pattern spans broadly and uniformly around the top edge of the mobile device 901 with few prominent side lobes and little distortion. Accordingly, various embodiments of FIG. 11 may offer improved performance compared to embodiments of FIGS. 7A and 7B.

Figure 12:
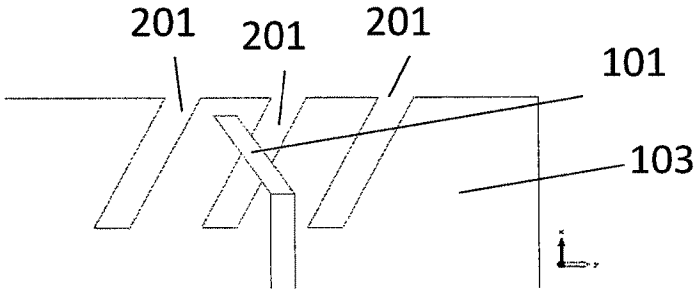
FIG. 12 illustrates an antenna with diagonally shaped slots in the ground plane, according to various embodiments of the present inventive concepts.

Referring now to FIG. 12, an antenna with diagonally shaped slots 201 in the ground plane 103 is illustrated. The slots 201 may be angled with respect to an edge of the ground plane 103. In some embodiments, the stripline 101 may include one or more bends that portion the stripline 101. The end of the stripline 101 with the one or more bends may overlap one of the diagonally shaped slots 201. The angle of the bend of the stripline 101 may be selected to facilitate the radiation pattern to approximately center around the stripline and associated diagonally shaped slot 201. The lengths of the portions of the stripline 101 may be selected such that when the stripline 101 is excited, coupling to slots near the stripling 101 achieves 0.25 wavelength of the resonance of the device.

Figure 13:
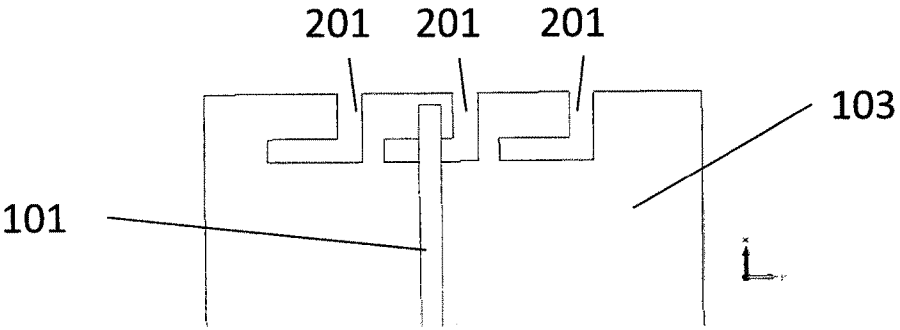
FIG. 13 illustrates an antenna with folded slots in the ground plane, according to various embodiments of the present inventive concepts.

Referring now to FIG. 13, an antenna with folded slots 201 in the ground plane 103 is illustrated. In some embodiments, the stripline 101 may be straight, without any bends. The shape of the stripline may be selected to avoid and/or reduce the parasitic coupling to neighboring striplines. The stripline 101 may overlap one of the folded slots 201. The stripline 101 may be positioned to facilitate the radiation pattern to approximately center around the stripline and associated folded slot 201.

The above discussed array antenna structures with periodic striplines and non-overlapped adjacent slots may form electromagnetic bandgap (EBG) structures. These EBG structures may form monopoles between the slots, thus controlling the radiation pattern of the antenna. The periodic monopoles created by the EBG structures may be along an edge of the device and serve to control electromagnetic patterns along the edge. A collection of EBG structures may form a parasitic monopole array, which provides beam forming functionality in addition to reduced side lobes. In some embodiments, these EBG structures may be implemented two-dimensionally on a printed circuit board. In some embodiments, phase shifters and/or time delay devices may be used in conductions with array antenna elements to control scanning angles to provide an equiphase wave front. The described inventive concepts create periodic antenna dielectric structures with high quality, low loss, and wide scanning angles.

Electromagnetic properties of EBG structures may be determined by physical dimensions and other parameters. For example, parameters such as stripline width, spacing between striplines, dielectric layer thickness, and dielectric layer permittivity may affect the electromagnetic properties of EBG structures and subsequently the antenna performance.

Many different embodiments have been disclosed herein, in connection with the above description and the drawings. It will be understood that it would be unduly repetitious and obfuscating to literally describe and illustrate every combination and subcombination of these embodiments. Accordingly, the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed various embodiments and, although specific terms are employed, they are used in a generic and descriptive sense only and not for purposes of limitation.

What is claimed is:

1. A wireless electronic device, comprising:

a ground plane including a plurality of slots located along an edge of the ground plane;

a dielectric layer on the ground plane; and a stripline on the dielectric layer opposite the ground plane, positioned to overlap one of the plurality of slots, wherein the stripline is further positioned to not overlap slots adjacent the one of the plurality of slots that the stripline overlaps, wherein slots that are not overlapped by the stripline are configured to reduce the propagation of surface waves near the stripline, wherein the wireless electronic device is configured to resonate at a resonant frequency when excited by a signal transmitted and/or received though the stripline, wherein a length of the one of the plurality of slots overlapped by the stripline is approximately 0.25 times a wavelength of the resonant frequency of the wireless electronic device;

wherein a length of one of the slots that are not overlapped by the stripline is approximately 0.25 times the wavelength of the resonant frequency of the wireless electronic device, and wherein the slots that are not overlapped by the stripline are substantially a same length as respective ones of the plurality of slots that are overlapped by the stripline.

2. The wireless electronic device of claim 1, wherein the stripline comprises a plurality of bends in the stripline that define a plurality of portions of the stripline, wherein respective lengths of each of the plurality of portions are selected to configure a wavelength of the stripline as approximately 0.25 times an effective wavelength of the resonant frequency of the wireless electronic device.

3. The wireless electronic device of claim 2, wherein the slots adjacent the one of the plurality of slots comprise a first slot on a first side of the one of the plurality of slots and a second slot on a second side, opposite the first side, of the one of the plurality of slots.

4. The wireless electronic device of claim 2, wherein the plurality of bends consists of two bends in the stripline.

5. The wireless electronic device of claim 2, wherein the bends in the stripline form approximately 90 degree angles between adjacent portions of the stripline.

6. The wireless electronic device of claim 2, wherein the plurality of bends in the stripline are configured to define a U-shaped end of the stripline.

7. The wireless electronic device of claim 6, wherein the U-shaped end of the stripline has a base and a pair of arms, and wherein the base is configured to pass over the one of the plurality of slots.

8. The wireless electronic device of claim 6, wherein the base is configured to pass over the one of the plurality of slots parallel to the edge of the ground plane.

9. The wireless electronic device of claim 6, wherein the base is configured to pass over and cross the one of the plurality of slots.

10. The wireless electronic device of claim 1, wherein the stripline is positioned to impedance match the dielectric layer and/or ground plane.

11. The wireless electronic device of claim 3, wherein a width of the one of the plurality of slots is approximately 0.2 times the length of the one of the plurality of slots.

12. The wireless electronic device of claim 1, wherein the stripline comprises a first stripline, the wireless electronic device further comprising:

one or more additional striplines, wherein each of the one or more additional striplines overlap respective ones of the plurality of slots, wherein the one or more additional striplines are further positioned to not overlap slots adjacent the respective ones of the plurality of slots overlapped by the one or more additional striplines.

13. The wireless electronic device of claim 12, wherein the one of the plurality of slots comprises a first slot, wherein the slots adjacent the first slot overlapped by the stripline comprise a second slot adjacent a first side of the first slot and a third slot adjacent a second side, opposite the first side of the first slot, wherein the one or more additional striplines comprise a second stripline that overlaps a fourth slot, that is adjacent a fifth slot and a sixth slot that are not overlapped by the first stripline or the one or more additional striplines, wherein the fifth slot is adjacent a first side of the fourth slot, and the sixth slot is adjacent a second side, opposite the first side of the fourth slot, and wherein the fifth slot is adjacent the third slot.

14. The wireless electronic device of claim 12, wherein a distance between adjacent ones of the plurality of slots is between 0.1 and 0.2 times a wavelength of the resonant frequency of the wireless electronic device.

15. The wireless electronic device of claim 12, wherein a distance between adjacent ones of the additional striplines is between 0.25 and 0.5 times a wavelength of the resonant frequency of the wireless electronic device.

16. The wireless electronic device of claim 12, wherein the first stripline and the one or more additional striplines are arranged in an array and are configured to receive and/or transmit multiple-input and multiple-output (MIMO) communication.

17. The wireless electronic device of claim 12, wherein respective radiation fields formed by the dielectric layer and the first stripline and/or the one or more additional striplines additively couple to form an electromagnetic radiation beam.

18. The wireless electronic device of claim 1, wherein at least one of the plurality of slots extend approximately perpendicular to the edge of the ground plane.

19. The wireless electronic device of claim 1, wherein at least one of the plurality of slots are diagonally oriented to the edge of the ground plane, and wherein the stripline comprises one or more bends and is positioned to overlap one of the plurality of slots.

20. The wireless electronic device of claim 1, wherein the plurality of slots are along one edge of the ground plane, and wherein the one edge of the ground plane is along an edge of a mobile device.

21. A wireless electronic device, comprising:

a ground plane including a plurality of slots located along an edge of the ground plane;

a dielectric layer on the ground plane; and a plurality of striplines on the dielectric layer opposite the ground plane, wherein each of the plurality of striplines is positioned to overlap a respective one of the plurality of slots, wherein each stripline of the plurality of striplines is further positioned to not overlap slots adjacent the respective one of the plurality of slots that the stripline overlaps, wherein slots that are not overlapped by the stripline are configured to reduce the propagation of surface waves near the stripline, and wherein the wireless electronic device is configured to resonate at a resonant frequency when excited by a signal transmitted and/or received though at least one of the plurality of striplines, and wherein the slots that are not overlapped by the stripline are substantially a same length as respective ones of the plurality of slots that are overlapped by the stripline.

22. The wireless electronic device of claim 1, wherein the one of the plurality of slots that the stripline overlaps is a same length as one of the slots that are not overlapped by the stripline.

* * * * *